US008776406B2

(12) United States Patent
Stephan

(10) Patent No.: US 8,776,406 B2
(45) Date of Patent: Jul. 15, 2014

(54) REVERSIBLE WING PLOW AND METHOD OF ROTATION

(71) Applicant: Michael Frederick Stephan, Shafer, MN (US)

(72) Inventor: Michael Frederick Stephan, Shafer, MN (US)

( * ) Notice: Subject to any disclaimer, the term of this patent is extended or adjusted under 35 U.S.C. 154(b) by 0 days.

(21) Appl. No.: 13/773,272

(22) Filed: Feb. 21, 2013

(65) Prior Publication Data

US 2013/0227863 A1 Sep. 5, 2013

Related U.S. Application Data

(60) Provisional application No. 61/606,294, filed on Mar. 2, 2012.

(51) Int. Cl.
*E01H 5/06* (2006.01)

(52) U.S. Cl.
USPC ..... 37/235; 37/267; 37/283; 37/408

(58) Field of Classification Search
USPC ..... 37/196, 235, 236, 241, 266, 267, 283, 37/408
See application file for complete search history.

(56) References Cited

U.S. PATENT DOCUMENTS

| | | | | | |
|---|---|---|---|---|---|
| 1,383,409 | A | * | 7/1921 | Volney | 37/233 |
| 2,595,277 | A | | 5/1952 | Mathias | |
| 2,856,709 | A | | 10/1958 | Brockly | |
| 2,891,459 | A | | 6/1959 | Tominac | |
| 2,904,904 | A | * | 9/1959 | Krueger | 37/275 |
| 2,994,138 | A | * | 8/1961 | Fourlan | 37/267 |
| 3,007,531 | A | | 11/1961 | Silver et al. | |
| 3,241,254 | A | | 3/1966 | Ulrich | |
| 3,279,104 | A | * | 10/1966 | Wandscheer et al. | 37/280 |
| 3,357,501 | A | | 12/1967 | Watts | |
| 3,657,828 | A | * | 4/1972 | Anderson | 37/274 |
| 3,908,289 | A | | 9/1975 | Ross | |
| 4,045,892 | A | | 9/1977 | Farrell | |
| 4,096,652 | A | | 6/1978 | Raines et al. | |
| 4,357,766 | A | | 11/1982 | Croteau et al. | |
| 4,798,011 | A | | 1/1989 | Sprinkle | |
| 4,953,625 | A | | 9/1990 | Hurworth | |
| 5,280,826 | A | | 1/1994 | Tanimizu et al. | |
| 6,249,992 | B1 | | 6/2001 | Irving et al. | |
| 6,363,631 | B1 | * | 4/2002 | Cordingley | 37/280 |
| 7,367,407 | B2 | * | 5/2008 | Lannert | 172/684.5 |

* cited by examiner

*Primary Examiner* — Gary Hartmann
(74) *Attorney, Agent, or Firm* — Patterson Thuente Pedersen, P.A.

(57) ABSTRACT

A reversible wing plow including a hitch, a moldboard and a moldboard shifting mechanism. The hitch is coupleable to the rear of a prime mover. The moldboard is operably coupled to the hitch proximate an inboard end and rotatable about a first horizontal axis that extends outwardly from the hitch generally parallel to a direction of forward movement of the prime mover. The moldboard shifting mechanism includes first and second linear actuators, both of which are coupled to the hitch at one end and coupled to opposing sides of a rotation crank plate on the other end. The crank plate is further operably coupled to the moldboard, whereby the moldboard is rotatably shiftable to the driver or passenger side of the prime mover, or to a vertically oriented transport position.

13 Claims, 9 Drawing Sheets

41
100
92
96
40
98

REVERSIBLE WING PLOW AND METHOD OF ROTATION

CLAIM TO PRIORITY

This application claims the benefit of U.S. Provisional Application 61/606,294, entitled "Reversible Wing Plow and Methods of Rotation" filed Mar. 2, 2012, which is hereby incorporated by reference.

TECHNICAL FIELD

The present invention relates generally to snow moving equipment. More particularly, the present invention relates to a wing plow for connection to the rear of a vehicle, wherein the wing plow includes a reversible moldboard that is configurable into a variety of positions.

BACKGROUND OF THE INVENTION

In the snow removal industry it is common practice to use a plow mounted to the front of a snow removal vehicle. The plow mounted to the front of the vehicle may be raised or lowered in relation to the traveled surface. When the plow is in the lowered position it is driven along by the vehicle; thereby pushing snow to one side or the other, depending on the operators' manipulation of the angle of the plow relative to the travel direction.

Side mounted wing plows to supplement the front plow are also well known to the snow removal industry. A side wing plow is generally used when extra width of the plowing swath is desired and the perceived risks involved in the employment of a side wing plow do not exceed the benefits. Typically the side wing is mounted to the side of a moving vehicle (tractor, truck, loader or grader). Side wing plows typically include a portion referred to as a side wing plow moldboard, which is a curved metal blade used for pushing snow.

With a typical side wing plow, an operator can manipulate the side wing plow moldboard up or down relative to the surface to be plowed, as well as angle the side wing plow moldboard relative to the direction of travel. When an operator configures the side wing plow to its plowing position, and the vehicle to which the side wing plow is attached is generally moving forward, snow is discharged down the length of, and past the end of the side wing plow moldboard, thereby creating a cleared path parallel to the direction of travel of the vehicle. Accordingly, by utilizing the side wing plow, the operator can increase the width of cleared snow (i.e., the swath width) beyond that which a front plow is capable of clearing alone. This extra swath width is beneficial because it increases the amount of cleared snow and pavement in a given pass, thereby increasing productivity and reducing the overall cost of the snow removal process.

U.S. Pat. No. 4,096,652, and entitled "Retractable Snowplow Wing and Mounting Therefor" discloses a side wing plow mounted to one side of a vehicle. However, side wing plows such as this are limited to use on only one side of the vehicle, thereby limiting the operator efficiency. To accommodate for special circumstances where a side wing plow mounted to the opposite side of the vehicle is needed, oftentimes there is a one vehicle with an opposite mounted wing plow within the fleet of plows. Furthermore, when this type of side wing is in a transport, or upright position, the side wing plow greatly increases the overall width of the vehicle, thereby increasing the risk of accident.

Another demonstration of prior art can be seen in U.S. Pat. No. 3,241,254, entitled "Snow Wing for Motor Graders". This again shows a side wing plow mounted to the side of a vehicle. Neither of these inventions allow for the immediate change of discharge of snow from one side of the vehicle to the other.

In accordance with the prior art, to accomplish snow discharge on either side of the vehicle, one would currently need to mount a large and cumbersome plowing apparatus on the rear of a vehicle; such a device is taught in U.S. Pat. No. 3,908,289, entitled "Swing-Over Snow Wing". This device, however, is extremely large and complex, and requires a great deal of thought and manipulation by the operator to function properly. This device further causes a significant decrease in operator visibility when the wing plow is in the transport position, thereby adding an unnecessary safety risk.

Another possible solution is taught in U.S. Pat. No. 7,367,407, entitled "Towed Snowplow and Method of Plowing." This device however, requires the plow to be trailered, thereby greatly reducing maneuverability. Accordingly, this device is not meant for use within cities where frequent backing up, or travel in reverse, may be necessary.

Collectively the prior art devices add immense weight, expense and complication to the efforts of snow removal. Moreover, because of their complexity and bulk, they decrease the operators' focus, comfort and, most importantly, public safety.

Accordingly, there is a need in the snow removal industry for a wing plow that has a moldboard that can easily be moved from one side of the vehicle to the other, thereby allowing an increased swath width on either side of the vehicle without significantly adding to the weight, expense and complication of snow removal.

Additionally, there is a need in the snow removal industry for a wing plow with a moldboard that can be transported while maximizing the visibility of the operator to improve safety.

SUMMARY OF THE INVENTION

The present invention provides embodiments of a reversible wing plow with a prime mover. The reversible wing plow is comprised of a hitch, a moldboard and a moldboard shifting mechanism. The hitch is coupleable to the prime mover at a rear of the prime mover. The moldboard has an inboard end and an outboard end. The moldboard is operably coupled to the hitch proximate the inboard end and rotatable about a first horizontal axis that extends outwardly from the hitch generally parallel to a direction of forward movement of the prime mover.

The mold board shifting mechanism includes a first linear actuator and a second linear actuator. The first linear actuator has a first fixed end coupled to the hitch and a second moving end. The second linear actuator has a second fixed end coupled to the hitch and a second movable end. The first movable end of the first linear actuator and the second movable end of the second linear actuator are coupled to a rotation crank plate on opposing sides of the rotation crank plate. The crank plate is further operably coupled to the moldboard proximate the inboard end of the moldboard via a rotation member whereby the moldboard is rotatably shiftable between a first position extending outwardly on a first side of the prime mover to a second position extending outwardly on a second side of the prior mover and to a vertically oriented transport position between the first position and the second position by coordinated extension and retraction of the first linear actuator and the second linear actuator.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The invention can be more completely understood in consideration of the following detailed description of various embodiments of the invention, in connection with the accompanying drawings, in which.

Figure 1:
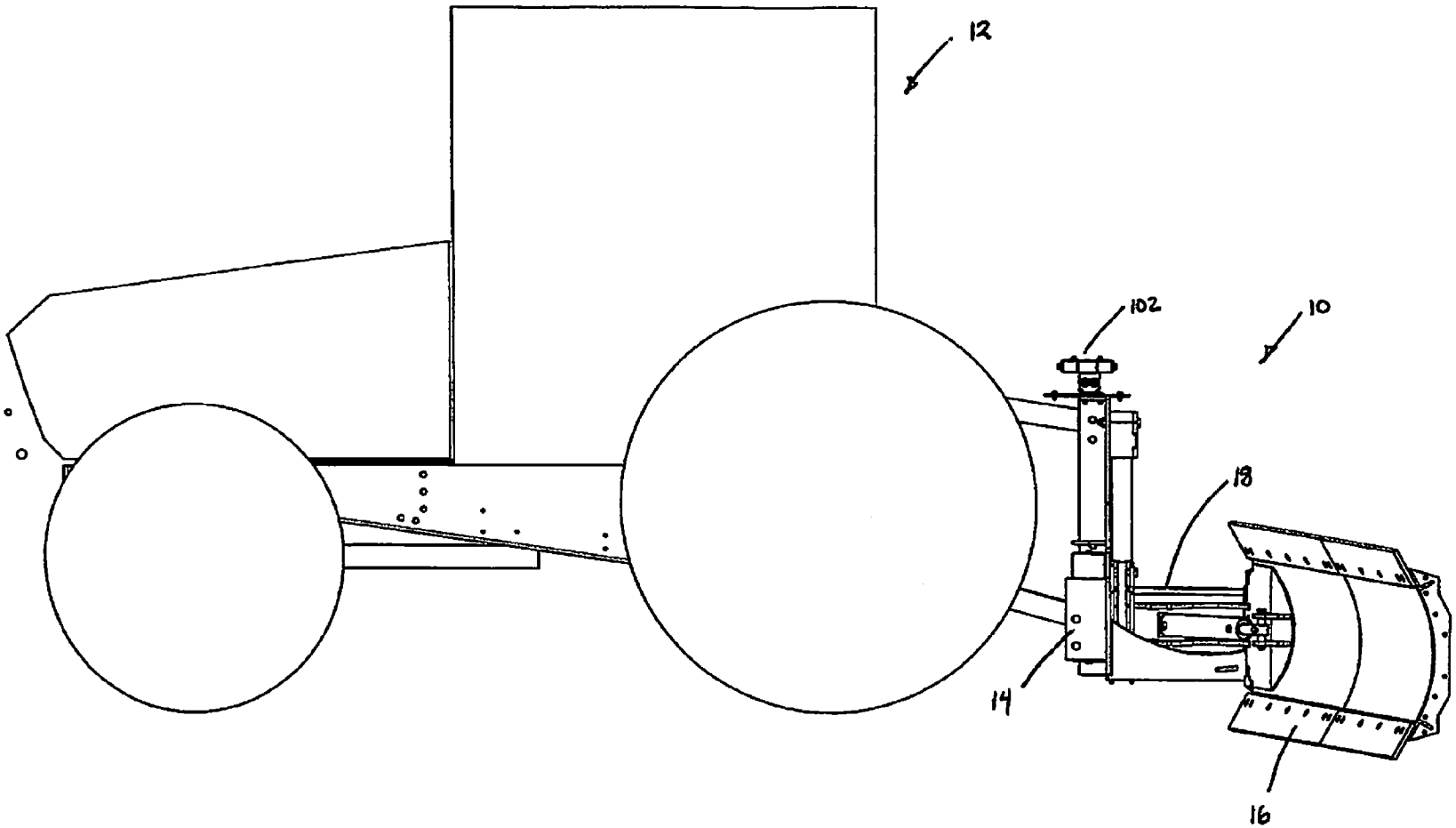
FIG. 1 depicts a side view of a prime mover with reversible wing plow deployed to the driver side plowing position mounted to the rear of the prime mover by means of a three point hitch in accordance with an example embodiment of the invention.

While the invention is amenable to various modifications and alternative forms, specifics thereof have by shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring now to the drawings and illustrative embodiments depicted therein, a reversible wing plow 10 for use with a prime mover 12 generally includes a hitch assembly 14, a moldboard assembly 16, a moldboard rotation assembly 18, and an electro hydraulic control system 20.

Figure 7B:
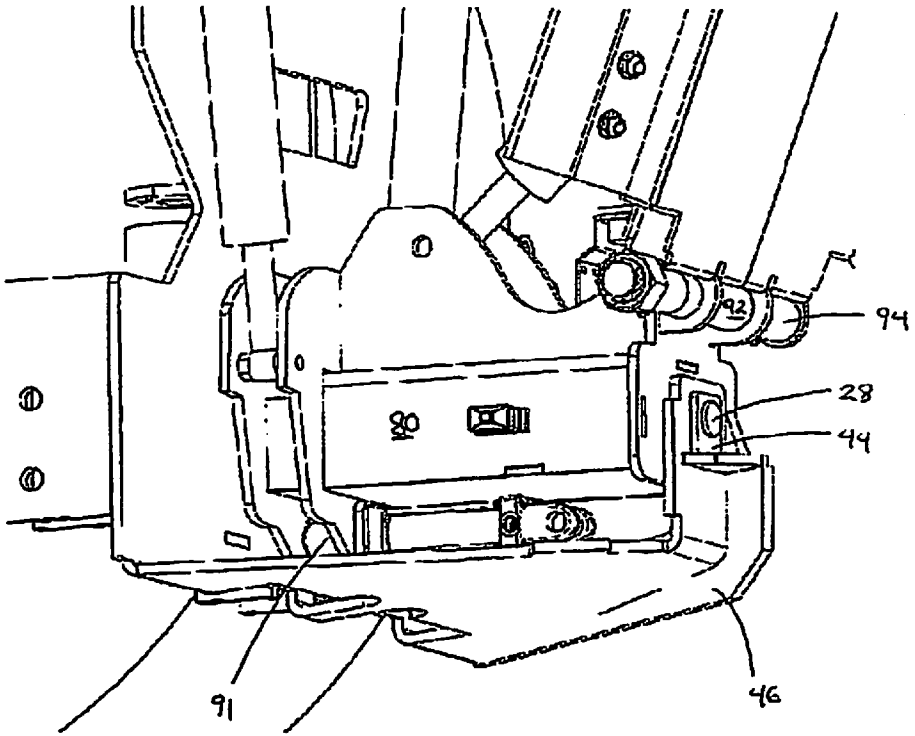
FIG. 7B depicts a close up isometric view of the automatic safety locking mechanism in transport mode in accordance with an example embodiment of the invention.
Figure 7A:
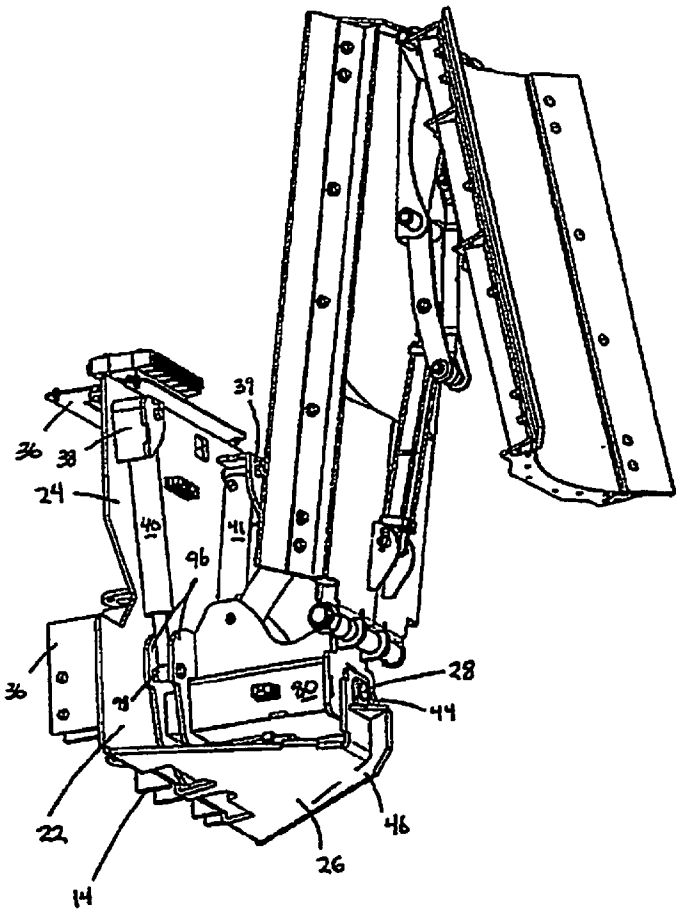
FIG. 7A depicts an isometric view of reversible wing plow with the moldboard folded in transport mode in accordance with an example embodiment of the invention.
Figure 8:
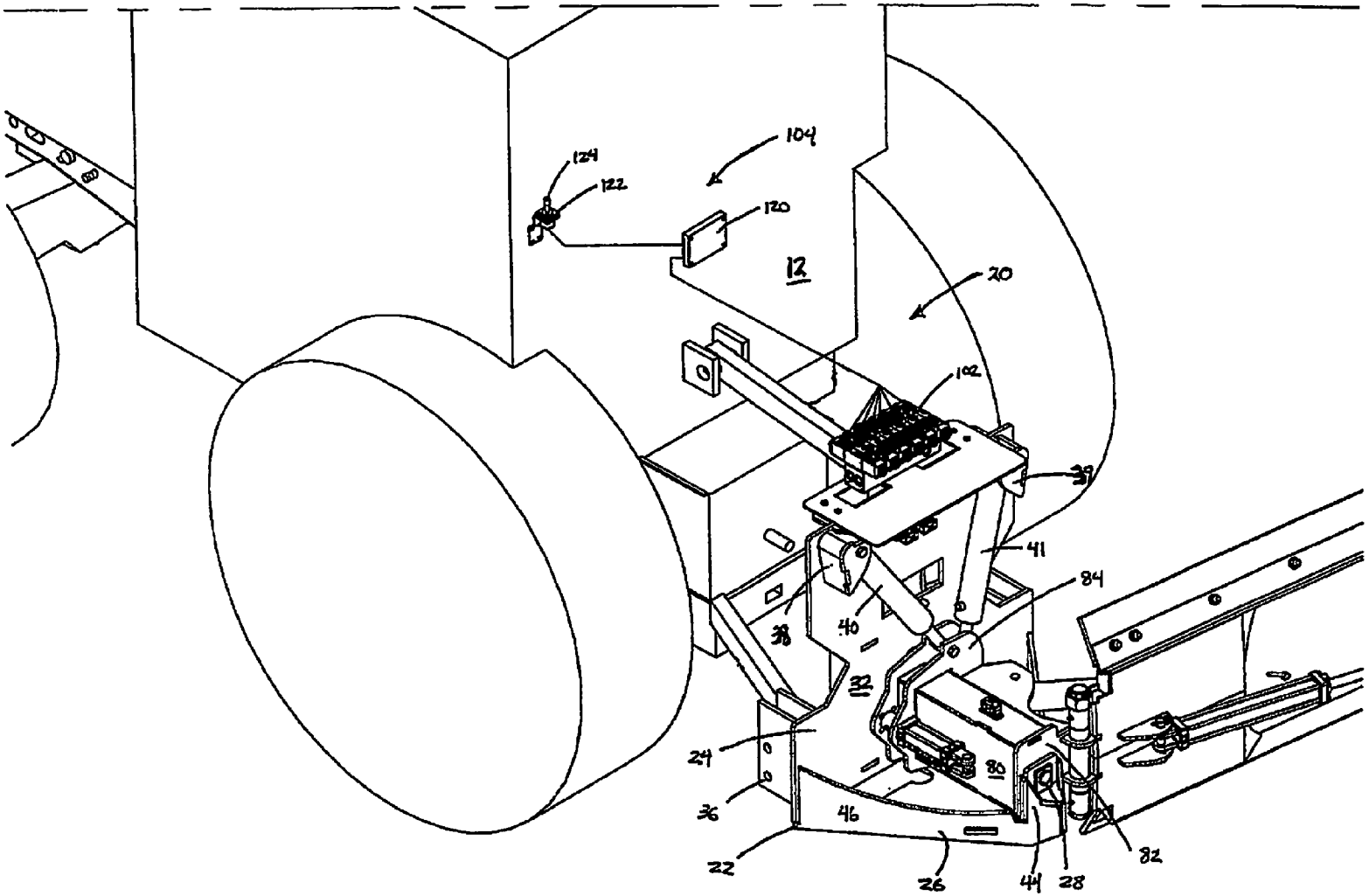
FIG. 8 depicts an isometric view of a prime mover with reversible wing plow including the operator-manipulated joystick and smart controller in accordance with an example embodiment of the invention.

As best seen in FIGS. 7A and 8, hitch assembly 14 includes an L-shaped hitch plate 22, a vertical member 24, a horizontal member 26, and a rotational shaft 28. In an example embodiment of the invention, L-shaped hitch plate 22 can be positioned between the rear of prime mover 12 and moldboard assembly 16. L-shaped hitch plate 22 can be integrated with, or coupled to, vertical member 24 and horizontal member 26.

Vertical member 24 has a front surface 30, a back surface 32 and an inboard shaft support 34. Front surface 30 includes at least one vehicle mount coupler 36 for removable connection to prime mover 12. Prime mover 12 can be a tractor, grader, loader, truck, or other suitable piece of motorized equipment having ground engaging wheels or tracks. In an example embodiment of the invention, vehicle mount coupler 36 can be a three-point hitch. The vehicle mount coupler 36 can allow for vertical ground clearance adjustment of reversible wing plow 10 separate from prime mover 12. Back surface 32 includes hydraulic ram supports 38 and 39, turning cylinders 40 and 41 and locking pin receiver 42. Hydraulic ram supports 38 and 39 provide connection points for coupling one end of turning cylinders 40 and 41 to vertical member 24. Turning cylinders 40 and 41 include a first double acting hydraulic lift cylinder 40 and a second double acting hydraulic lift cylinder 41. Vertical member 24 further includes locking pin receiver 42. Inboard shaft support 34 provides a rotational coupling point to, and support for, the inboard end of rotational shaft 28.

Horizontal member 26 includes outboard shaft support 44 and reinforcements 46. Outboard shaft support 44 provides a rotational coupling point to, and support for, the outboard end of rotational shaft 28. Reinforcements 46 provide ample structural support for maintaining rotational shaft 28 substantially fixed in position relative to L-shaped hitch plate 22, particularly when subjected to external forces in operation.

Rotational shaft 28 is oriented substantially horizontal and substantially parallel to the direction of travel of prime mover 12. Rotational shaft 28 is supported at by inboard shaft support 34 and outboard shaft support 44. Rotational shaft 28 can be laterally secured in place relative to the L-shaped hitch plate 22, for example by a large nut or other common retainer.

Figure 2:
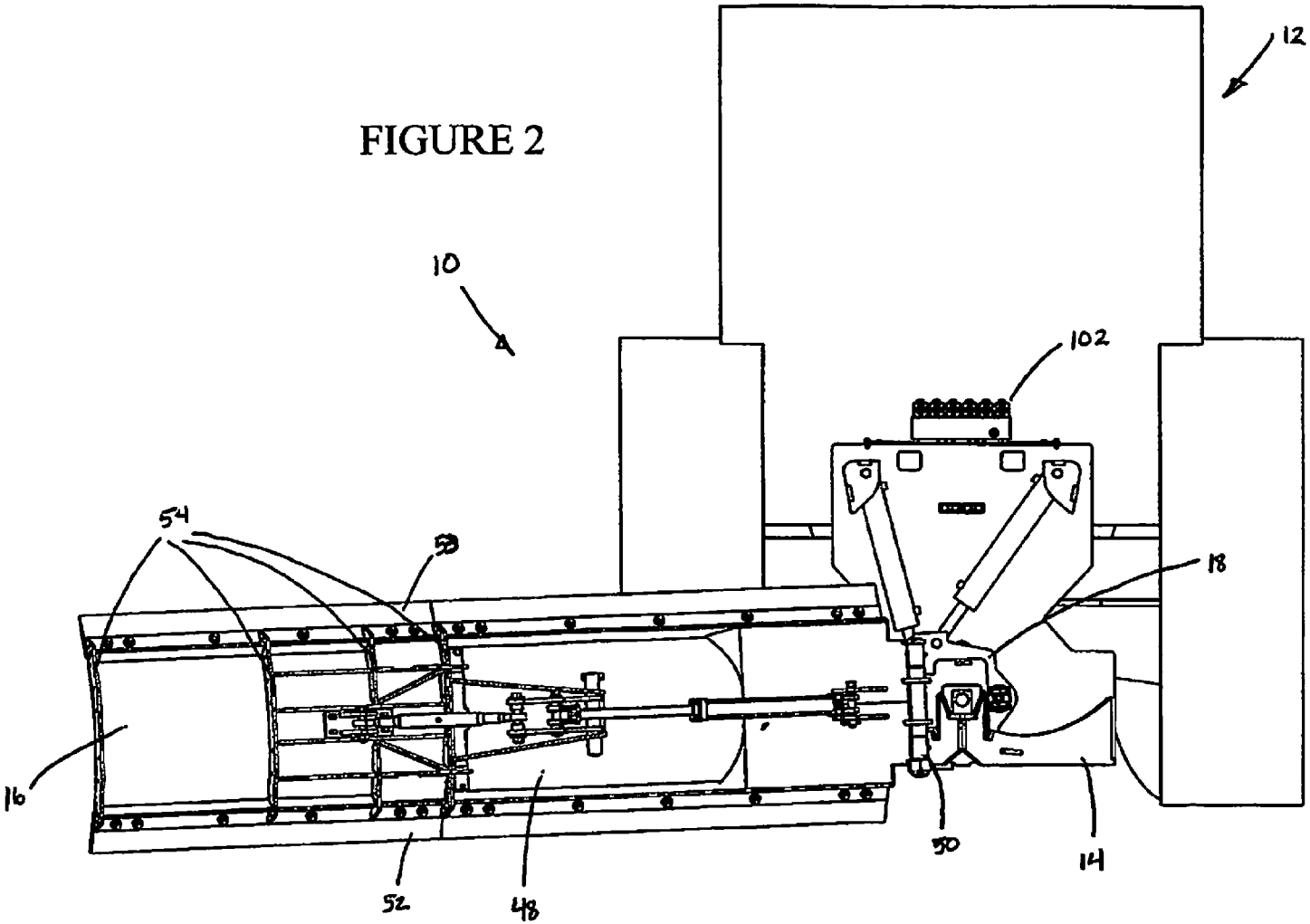
FIG. 2 depicts a rear view a prime mover with reversible wing plow deployed to the driver side plowing position in accordance with an example embodiment of the invention.
Figure 3:
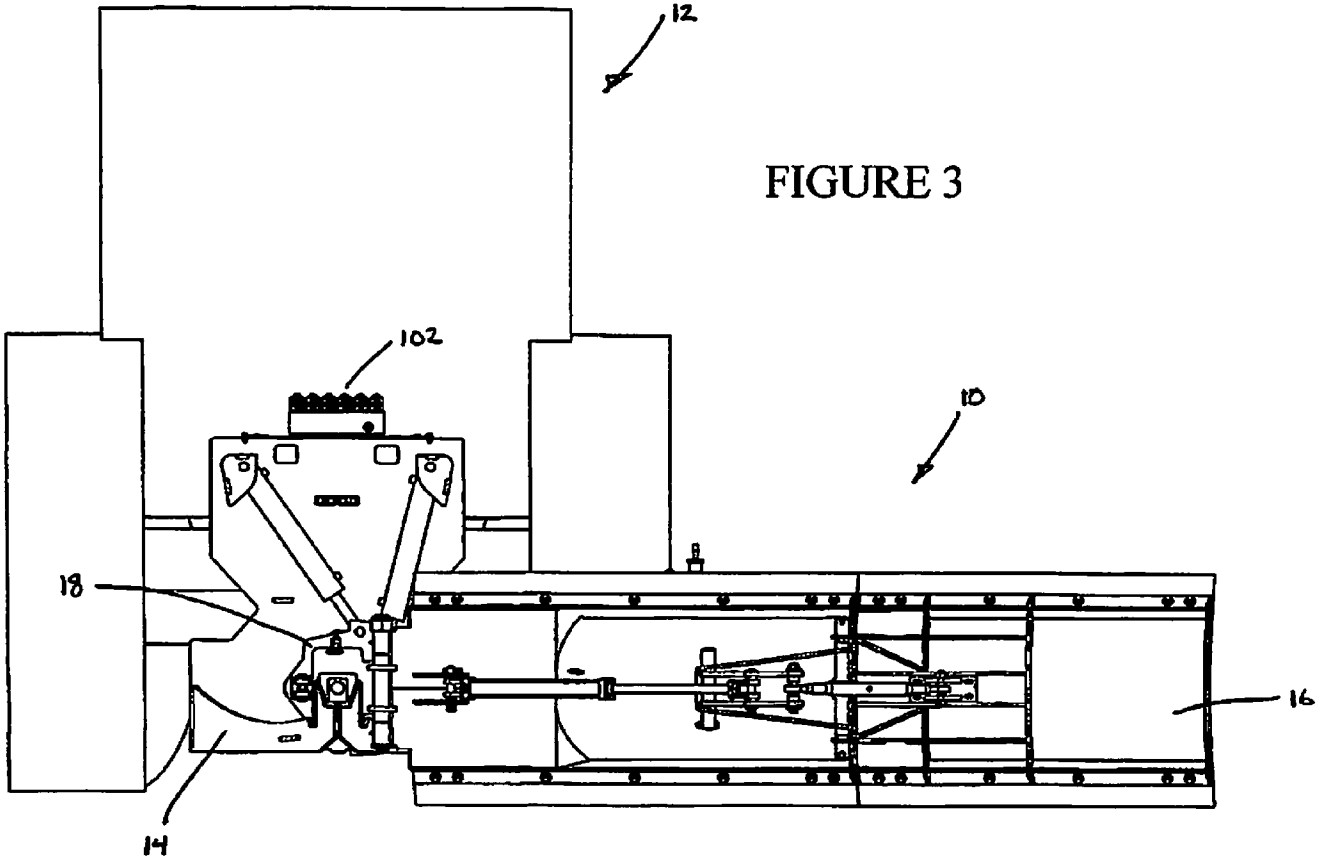
FIG. 3 depicts a rear view a prime mover with reversible wing plow deployed to the passenger side plowing position in accordance with an example embodiment of the invention.
Figure 4:
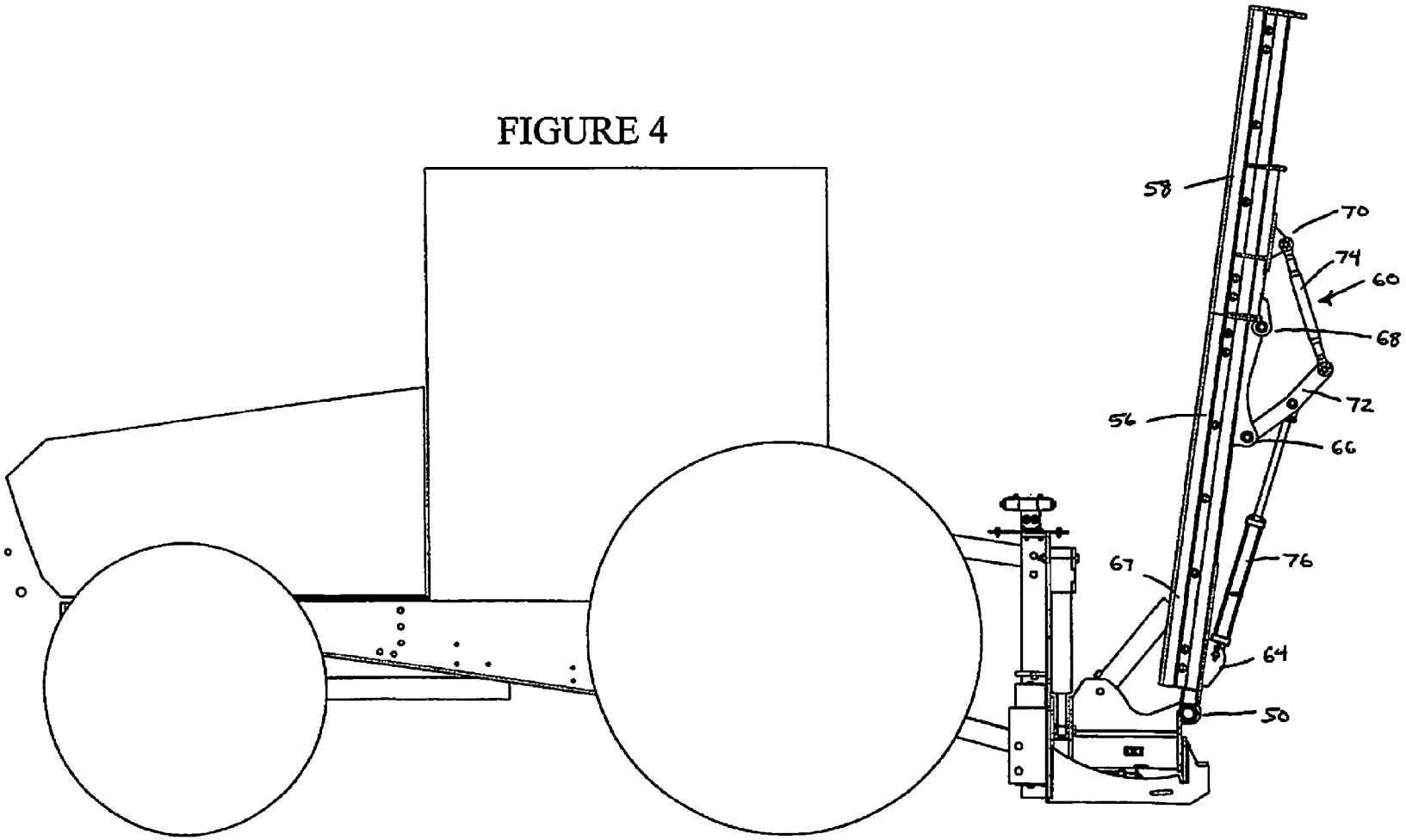
FIG. 4 depicts a side view of a prime mover with reversible wing plow positioned substantially vertically in accordance with an example embodiment of the invention.

As best seen in FIGS. 2, 4 and 7A, moldboard assembly 16, generally includes moldboard 48 and moldboard hinge knuckle 50. In the depicted embodiment, moldboard 48 includes cutting edges 52 and 53, bracing 54, inboard portion 56, outboard portion 58, and folding linkage assembly 60.

Cutting edges 52 and 53 include a first cutting edge 52 and a second cutting edge 53. Cutting edges 52 and 53 are positioned opposite one another on the lateral edges of moldboard 48. Cutting edges 52 and 53 can be coupled to moldboard 48 in a manner that allows ease in periodic replacement, for example with a series of bolts or other suitable fasteners.

In an example embodiment of the invention, bracing 54 provides ample structural support for substantially maintaining the shape of moldboard 48, particularly when subjected to external forces in operation. Bracing can be coupled both horizontally and vertically along a surface of moldboard 48.

Inboard portion 56 of moldboard 48 includes folding cylinder mount 64, link arm mount 66, angle cylinder mount 67, and a portion of folding hinge 68. Folding cylinder mount 64 provides a connection point for pivotably coupling one end of double acting folding cylinder 76 to inboard portion 56. Link arm mount 66 provides a connection point for pivotably coupling one end of link arm 72 to inboard portion 56. In an example embodiment of the invention, angle cylinder mount 67, can be coupled to the side of moldboard opposite folding cylinder mount 64 and link arm mount 66, as show in FIG. 6. Angle cylinder mount 67 provides a connection point for pivotably coupling one end of angle cylinder 88 to moldboard assembly 16.

In the depicted embodiment, outboard portion 58 of moldboard 48 includes pushrod mount 70 and a portion of folding hinge 68. Pushrod mount 70 provides a connection point for pivotably coupling one end of push rod 74 to outboard portion 58. Corresponding portions of folding hinge 68 are respectively coupled to inboard portion 56 and outboard portion 58 of moldboard 48. These portions can be joined, for example by a pin, thereby hingedly coupling inboard portion 56 to outboard portion 58.

Inboard portion 56 and outboard portion 58 of moldboard 48 can have a curved shape, thereby forming a channel to accommodate the flow of snow along the length of moldboard 48 when plowing.

In an example embodiment, folding linkage assembly 60 includes link arm 72, pushrod 74 and double acting folding cylinder 76. In an example embodiment of the invention, pushrod 74, is pivotably coupled to outboard portion 58 at one end, and pivotably coupled to an end of link arm 72 on its other end. Link arm 72 is pivotably coupled to an end of pushrod 74 at one end and pivotably coupled to inboard portion 56 on the other end. Folding cylinder 76 is a double acting cylinder and is pivotably coupled to inboard portion 56 at one end, and pivotably coupled to an intermediate location on link arm 72 at its 76 the other end.

Moldboard hinge knuckle 50 is coupled to the inboard portion 56 of moldboard 48, proximate the end opposite folding hinge 68. Moldboard hinge knuckle 50 can be joined, for example, by hinge pin 94 to rotation member knuckle 92, thereby hingedly coupling moldboard assembly 16 to moldboard rotation assembly 18. Hinge pin 94 can be secured in place by a nut or other common retainer.

As best seen in FIGS. 5, 6, 7B, and 8, moldboard rotation assembly 18 includes box channel 80, hinge plate 82, rotation crank plate 84, angle cylinder support plate 86, angle cylinder 88, and locking cylinder 90.

Box channel 80 is supported by, and rotationally coupled to, rotation shaft 28. Hinge plate 82 is coupled to the end of box channel 80 distal to hitch assembly 14. Hinge plate 82 includes rotational member knuckle 92 and hinge pin 94.

Rotation crank plate 84 is coupled to the end of box channel 80 opposite hinge plate 82, proximate to hitch assembly 14. As best seen in FIGS. 5, in an example embodiment of the invention, rotation crank plate 84 includes two similar plates 96, a first cylinder pin 98 and a second cylinder pin 100. The two similar plates 96 can have apertures appropriately sized to accommodate first and second cylinder pins 98 and 100. First cylinder pin 98 pivotably couples the end of first turning cylinder 40 to two similar plates 96. Second cylinder pin 100 pivotably couples the end of second lift cylinder 41 to two rotation crank plates 96.

Figure 6:
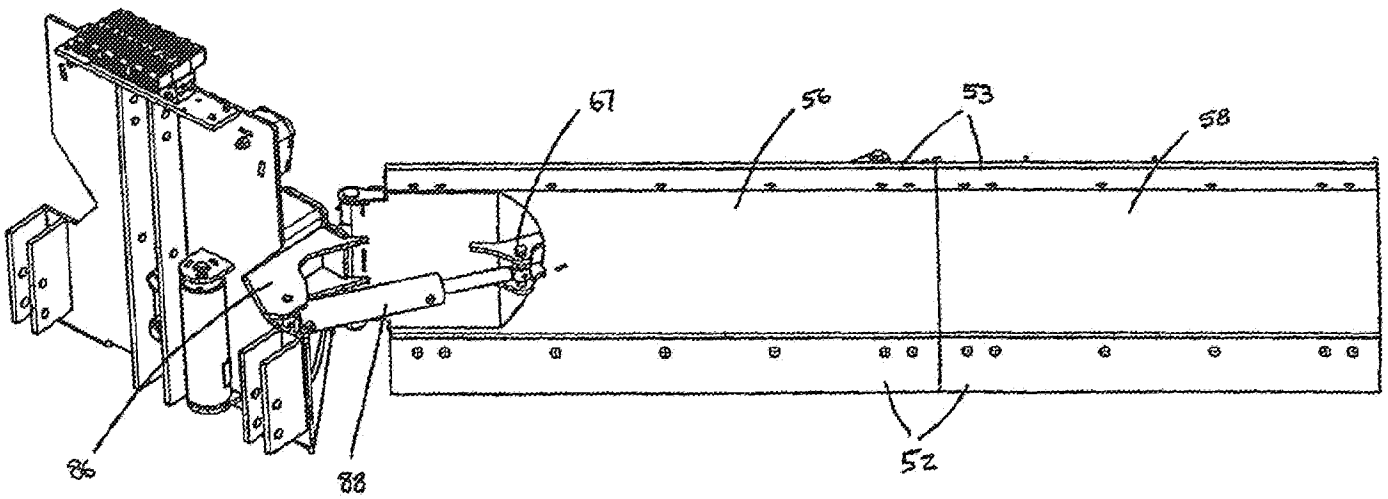
FIG. 6 depicts an isometric view of the operable coupling of the inboard end of the moldboard to the crank plate via a rotation member in accordance with an example embodiment of the invention.

As best seen in FIGS. 6, angle cylinder support plate 86 is coupled to box channel 80. Angle cylinder support plate 86 pivotably couples to one end of angle cylinder 88. The opposite end of angle cylinder 88 pivotably couples to angle cylinder support 67 of the moldboard assembly 16.

As best seen in FIG. 7B, locking cylinder 90 includes locking pin 91, and is coupled to, and can be positioned substantially parallel to, the length of box channel 80 such that locking pin 91 can selectively extend through an aperture in two similar plates 96 and into locking pin receiver 42 of hitch assembly 14.

Figure 9:
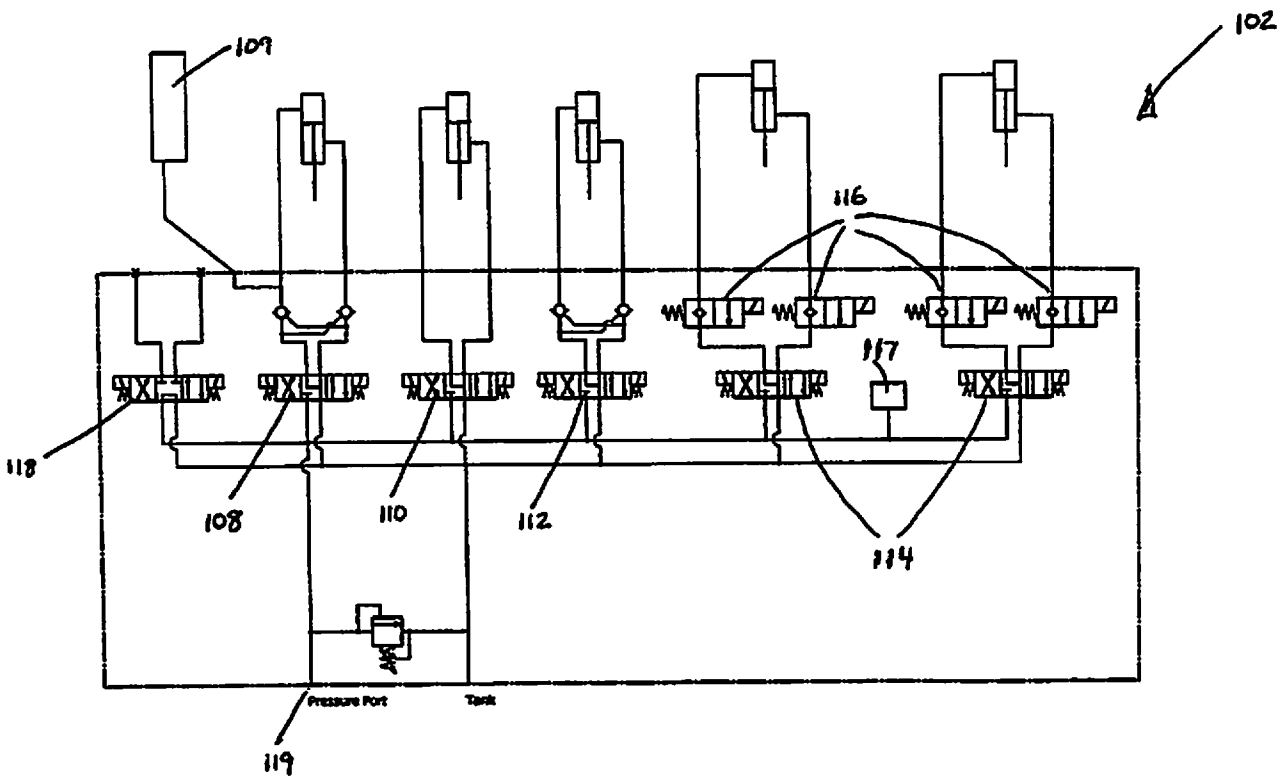
FIG. 9 depicts a schematic of the hydraulic control system in accordance with an example embodiment of the invention.

As best seen in FIGS. 8 and 9, according to an example embodiment, electro hydraulic control system 20 includes hydraulic controls 102 and electronic control 104.

Hydraulic controls 102 generally include angle cylinder valve 108, accumulator 109, lock cylinder valve 110, folding cylinder valve 112, turning cylinder valves 114, float valves 116, pressure sensor 117, directional control valve 118, and vehicle auxiliary 119. Hydraulic controls 102 receive hydraulic pressure from a vehicle auxiliary 119.

Electronic control 104 includes controller 120, joystick 122 and button 124. Controller 120 is a computer device that senses various electrical inputs and executes preset programs based on the sensed various electrical inputs. Controller 120 is in communication with hydraulic controls 102. Joystick 122 and button 124 can be manipulated by an operator to provide various electrical inputs to controller 120.

In operation, moldboard assembly 16 can rotate about the rotational shaft 28 of hitch assembly 14 more than 180 degrees, allowing the change of plowing positions from one side of prime mover 12 to the other side of prime mover 12. In an example embodiment of the invention, rotation of moldboard assembly 16 is caused by turning cylinders 40 and 41. Other methods of rotation, such as chains, cable, gears and motor are also contemplated.

Figures 5A, 5B, 5C:
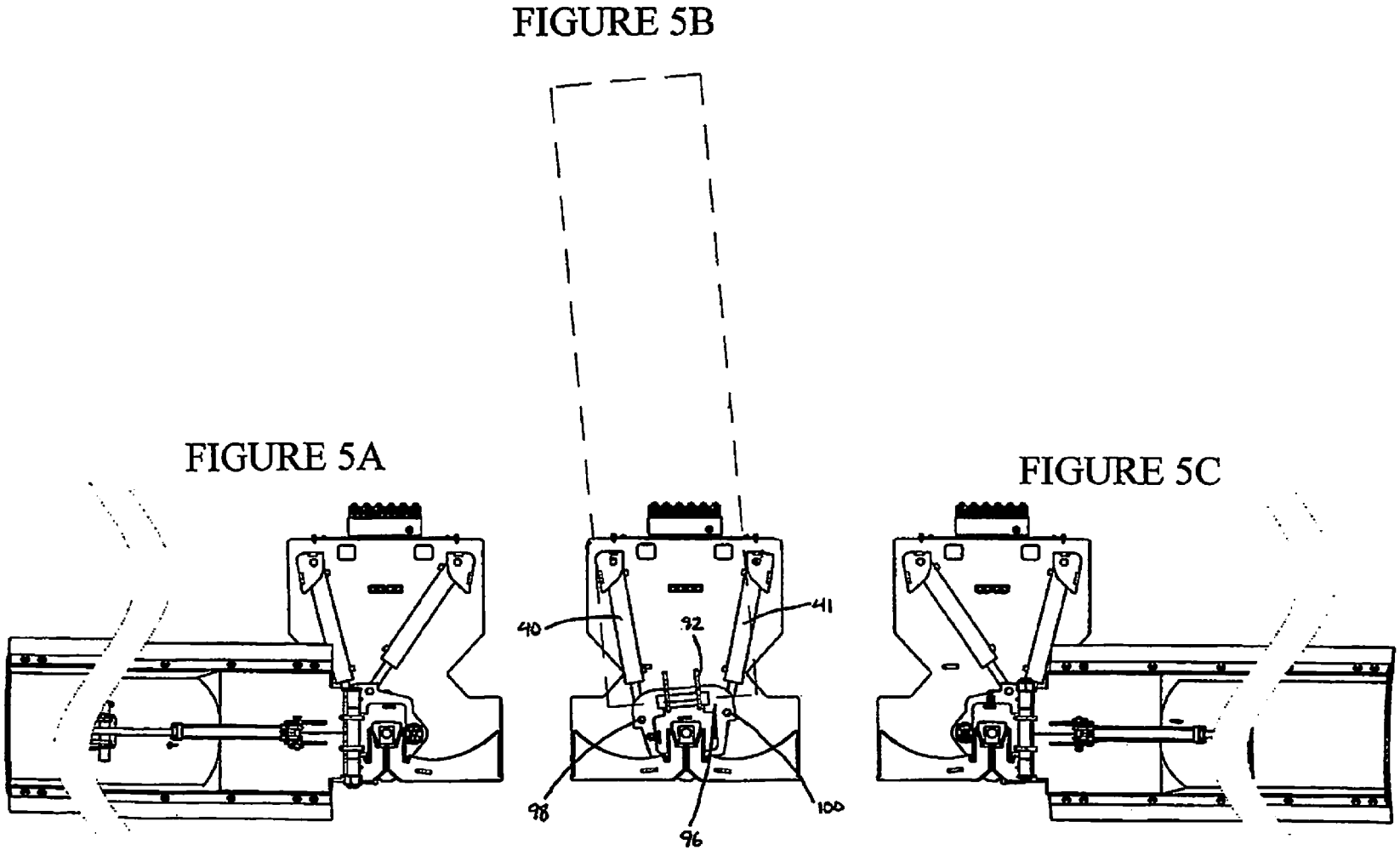
FIGS. 5A through 5C depict close-up rear view of the horizontal rotation of the wing plow moldboard as it hydraulically rotates relative to the prime mover in accordance with an example embodiment of the invention.

To rotate moldboard assembly 16 from the driver side plowing position (as shown in FIG. 5A) to the passenger side plowing position (as shown in FIG. 5C) the operator can manipulate joystick 122 towards the passenger side of prime mover 12 until rotation is complete. Manipulation of joystick 122 will activate controller 120, which in this case, executes a preset program to activate the lift mode of hydraulic controls 102. Upon activating the lift mode of hydraulic controls 102, individual valves 114, 116 and 118 are activated and fluid pressure is directed to turning cylinders 40 and 41, thereby retracting turning cylinders 40 and 41 until they reach their equalized point (as shown in FIG. 5B). Once this equalized point is reached, and no further hydraulic fluid can be displaced, a pressure spike occurs in hydraulic controls 102. This pressure spike causes pressure sensor 117 to send a signal to controller 120. This input from pressure sensor 117 causes controller 120 to execute a preset program to activate the drop mode of hydraulic controls 102. Once the drop mode is activated controller 120 will take into consideration the direction in which the operator has manipulated joystick 122. Based on a preset program, then controller 120 activates valves 114 to reverse the flow of hydraulic fluid to one of the turning cylinders 40 and 41. The reversed turning cylinder 40 or 41 then extends, thereby overpowering the other turning cylinder 40 or 41 to continue rotation of moldboard assembly 16 in the direction that the operator has manipulated joystick 122.

If the operator continues to hold joystick 122 in the same position after rotation of moldboard assembly 16 has subsided, controller 120 executes a preset program to activate the float mode of hydraulic controls 102. The float mode removes retraction or extension pressure to turning cylinders 40 and 41 and allows free movement of hydraulic fluid through the turning cylinders 40 and 41, thereby allowing gravity to keep cutting edge 52 or 53 of moldboard 48 against the plowing surface, particularly in uneven terrain. Float mode is activated by deactivating individual valves 114 and 118, but allowing valves 116 to remain active. After float mode is activated, the operator can release joystick 122.

Moldboard assembly 16 is pivotable about moldboard hinge knuckle 50, so as to angle moldboard 48 in relation to the direction of travel of prime mover 12 by manipulation of joystick 122 forward or backward in relation to prime mover 12. Manipulation of joystick 122 forward or backward sends an input signal to controller 120. Controller 120 then directs hydraulic pressure to angle cylinder 88 via hydraulic controls 102. Accordingly, when an operator manipulates joystick 122 forward, Moldboard assembly 16 pivots forward about moldboard hinge knuckle 50 until moldboard 48 is substantially perpendicular to the direction of travel of prime mover 12. When an operator manipulates joystick 122 backward, moldboard assembly 16 pivots aft about moldboard hinge knuckle 50 until the discharge angle of moldboard 48 is at a maximum relative to the direction of travel of prime mover 12. Accordingly, by adjusting the angle of moldboard 48, the operator can change the discharge angle of the reversible wing plow 10, thereby varying the effective swath width.

In addition to varying the swath width, there can be a safety function to allow moldboard 48 to automatically rotate about moldboard hinge knuckle 50 or angle back when encountering an obstacle. This is accomplished via accumulator 109 to create a hydraulic spring; however other methods, such as coil springs are also contemplated.

Inboard portion 56 and outboard portion 58 of moldboard 48 can pivot about folding hinge 68, thereby allowing moldboard 48 to be folded approximately in half, or at least reducing the overall length of moldboard 48. This folded position is intended for used primarily when in the transport mode as depicted in FIG. 7A.

Reversible wing plow 10 can be put into transport mode by depressing button 124. Transport position is used when the reversible wing plow 10 is not in use; non-use can occur when driving from one area to another or when an increased swath width is not necessary. When controller 120 receives input that button 124 has been depressed, controller 120 executes a preset program to activate the lift mode of hydraulic controls 102. As discussed previously, upon activating the lift mode of hydraulic controls 102, individual valves 114, 116 and 118 are activated and fluid pressure is directed to turning cylinders 40 and 41, thereby retracting turning cylinders 40 and 41 until they reach their equalized point (as shown in FIG. 5B). Once this equalized point is reached, and no further hydraulic fluid can be displaced, a pressure spike occurs in hydraulic controls 102. This pressure spike causes pressure sensor 117 to send a signal to controller 120.

If no further operator manipulation is sensed, the controller 120 then executes a preset program to activate hydraulic controls 102 to send fluid pressure to folding cylinder 76, thereby retracting folding cylinder 76 and pivotally folding moldboard 48 about folding hinge 68. After a pre-programmed time has elapsed, controller 120 deactivates hydraulic controls 102, thereby removing the pressure directed to folding cylinder 76.

Controller 120 then executes a preset program to activate hydraulic controls 102 to send fluid pressure to locking cylinder 90, causing locking pin 91 to drive forward and become seated in locking pin receiver 42 of hitch assembly 14, thereby physically stopping any rotation of moldboard assembly 16 relative to hitch assembly 14. Locking cylinder 90 is a safety mechanism so that even if there is a hydraulic failure, the moldboard assembly 16 will not inadvertently fall.

For transition from transport mode to operation mode (i.e., the driver side plowing position or the passenger side plowing position), the operator manipulates joystick 122 towards either the driver side or passenger side of prime mover 12. Manipulation of joystick 122 activates controller 120, which in this case, executes a preset program to activate the lift mode of hydraulic controls 102. Upon activating the lift mode, hydraulic control 102 disengages locking cylinder 90, thereby removing locking pin 91 from locking pin receiver 42. Because both turning cylinders are already in the equalized point a pressure spike occurs in hydraulic controls 102. This pressure spike causes pressure sensor 117 to send a signal to controller 120. This input from pressure sensor 117 causes controller 120 to execute a preset program to activate the drop mode of hydraulic controls 102. Once the drop mode is activated controller 120 takes into consideration the direction in which the operator has manipulated joystick 122. Based on a present program, then controller 120 activates valves 114 to reverse the flow of hydraulic fluid to one of the turning cylinders 40 and 41. The reversed turning cylinder 40 or 41 then extends, thereby overpowering the other turning cylinder 40 or 41 to continue rotation of moldboard assembly 16 in the direction that the operator has manipulated joystick 122.

If the operator continues to hold joystick 122 in the same position after rotation of moldboard assembly 16 has subsided, controller 120 executes a preset program to activate the float mode of hydraulic controls 102. The float mode removes retraction or extension pressure to turning cylinders 40 and 41, and allows free movement of hydraulic fluid through the turning cylinders 40 and 41, thereby allowing gravity to keep cutting edge 52 or 53 of moldboard 48 against the plowing surface, particularly in uneven terrain. Float mode is activated by deactivating individual valves 114 and 118, but allowing valves 116 to remain active. After float mode is activated, the operator can release joystick 122.

Controller 120 then executes a preset program to activate hydraulic controls 102 to send fluid pressure to folding cylinder 76, thereby extending folding cylinder 76 and pivotally unfolding moldboard 48 about folding hinge 68. After a pre-program time has elapsed, and moldboard 48 is fully extended, controller 120 deactivates hydraulic controls 102, thereby removing the pressure directed to folding cylinder 76.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed is:

1. A reversible wing plow for use with a prime mover, comprising:

a hitch that that is coupleable to the prime mover at a rear of the prime mover;

a moldboard having an inboard end and an outboard end that is operably coupled to the hitch proximate the inboard end and rotatable about a first horizontal axis that extends outwardly from the hitch generally parallel to a direction of forward movement of the prime mover;

a moldboard shifting mechanism including a first linear actuator and a second linear actuator, the first linear actuator having a first fixed end coupled to the hitch and a second moving end, the second linear actuator having a second fixed end coupled to the hitch and a second movable end, the first movable end of the first linear actuator and the second movable end of the second linear actuator being coupled to a rotation crank plate on opposing sides of the rotation crank plate that is further operably coupled to the moldboard proximate the inboard end of the moldboard via a rotation member whereby the moldboard is rotatably shiftable between a first position extending outwardly on a first side of the prime mover to a second position extending outwardly on a second side of the prior mover and to a vertically oriented transport position between the first position and the second position by coordinated extension and retraction of the first linear actuator and the second linear actuator.

2. The reversible wing plow as claimed in claim 1, further comprising a hinged linkage between the inboard end of the mold board and the rotation member having a generally vertical axis of rotation when the moldboard is in the first position or the second position about which the moldboard is angularly adjustable relative to the direction of forward movement of the prime mover.

3. The reversible wing plow as claimed in claim 2, further comprising an angling linear actuator coupled between the rotation member and the moldboard by which the moldboard is angularly adjustable.

4. The reversible wing plow as claimed in claim 1, further comprising an inboard portion and an outboard portion coupled by a hinge whereby the moldboard is foldable to a transport configuration.

5. The reversible wing plow as claimed in claim 4, further comprising a folding linkage.

6. The reversible wing plow as claimed in claim 4, wherein the folding linkage further comprises a folding linear actuator secured to the inboard portion at a first end thereof coupled to the outboard portion by a link arm and a pushrod at a second end thereof.

7. The reversible wing plow as claimed in claim 1, further comprising an electronic controller that senses a spike increase in resistance to movement of the rotation member proximate the vertically oriented transport position while the first linear actuator and the second linear actuator are both retracting to shift the rotation member from one of the first position and the second position past the vertically oriented transport position and commands one of the first linear actuator and the second linear actuator to begin extending to shift the rotation member toward the other of the of the first position and the second position.

8. The reversible wing plow as claimed in claim 7, further comprising a joystick operably coupled to the electronic controller which actuates the electronic controller to control the first linear actuator and the second linear actuator.

9. The reversible wing plow as claimed in claim 3, further comprising a joystick operably coupled to an electronic controller that actuates the angling linear actuator.

10. The reversible wing plow as claimed in claim 9, wherein forward motion of the joystick actuates the angling linear actuator to move the moldboard forward to be angled more closely to perpendicular to the direction of forward movement of the prime mover and wherein rearward motion of the joystick actuates the angling linear actuator to move the moldboard rearward to be angled less closely to perpendicular to the direction of forward movement of the prime mover.

11. The reversible wing plow as claimed in claim 6, further comprising a joystick having a control button operably coupled to an electronic controller that actuates the folding linear actuator.

12. The reversible wing plow as claimed in claim 11, wherein actuation of the control button, when the moldboard is in the vertically oriented transport position, operably actuates the folding linear actuator to fold or unfold the moldboard.

13. The reversible wing plow as claimed in claim 1, further comprising a joystick operably coupled to an electronic controller, wherein movement of the joystick to a first side operably actuates the electronic controller to rotatably shift the moldboard toward the first position extending outwardly on the first side of the prime mover and movement of the joystick to a second side operably actuates the electronic controller to rotatably shift the moldboard toward the second position extending outwardly on the second side of the prime mover from the vertically oriented transport position between the first position and the second position.

* * * * *